US012740605B2

(12) United States Patent
Darby

(10) Patent No.: US 12,740,605 B2
(45) Date of Patent: Sep. 22, 2026

(54) FIT ADJUSTER FOR PANT LEGS

(71) Applicant: Gina Michelle Darby, Oklahoma City, OK (US)

(72) Inventor: Gina Michelle Darby, Oklahoma City, OK (US)

( * ) Notice: Subject to any disclaimer, the term of this patent is extended or adjusted under 35 U.S.C. 154(b) by 0 days.

(21) Appl. No.: 17/014,049

(22) Filed: Sep. 8, 2020

(65) Prior Publication Data

US 2022/0071314 A1 Mar. 10, 2022

(51) Int. Cl.
*A41D 1/06* (2006.01)
*A41D 27/08* (2006.01)
*A41D 31/18* (2019.01)

(52) U.S. Cl.
CPC ..... *A41D 1/067* (2013.01); *A41D 27/08* (2013.01); *A41D 31/18* (2019.02)

(58) Field of Classification Search
CPC ..... A41D 1/067; A41D 27/08; A41D 27/145; A41D 17/005; A41D 1/10; A41D 15/002; A41D 2300/33; A41D 27/24; A41D 2300/20; A41D 2300/22; A41D 1/18; A41D 1/089; A41D 1/08; A41D 1/086; A41D 13/065; A41D 13/0568; A41D 3/06; A41D 13/1254; A41D 1/06; A41F 17/04; A41F 3/02; A43B 21/4011
USPC ..... 2/231, 311, 312
See application file for complete search history.

(56) References Cited

U.S. PATENT DOCUMENTS 251,257 A * 12/1881 Ligabue ..... A41D 1/06 2/232
905,099 A * 11/1908 Price ..... A41D 27/08 2/244
1,055,663 A * 3/1913 Scheinman ..... A41D 1/089 2/228
1,066,881 A * 7/1913 Breslin ..... A41D 1/08 2/228
1,142,201 A * 6/1915 Peterson ..... A41B 9/02 2/314
1,440,121 A * 12/1922 Abrahamson ..... A41D 13/0568 2/62
1,547,166 A * 7/1925 Davidson ..... A41D 13/065 2/24
1,549,672 A * 8/1925 Lazier ..... A41F 3/00 2/323

(Continued)

FOREIGN PATENT DOCUMENTS

DE 3326009 A1 1/1985
EP 0438979 B1 2/1994

(Continued)

OTHER PUBLICATIONS

Translation of KR10-2010-0018955 (Year: 2010).*

(Continued)

*Primary Examiner* — Grady Alexander Nunnery
(74) *Attorney, Agent, or Firm* — Robert H. Frantz

(57) ABSTRACT

A fit adjuster for a portion of a pant leg comprises a first strip attached to an inseam position of a pant leg and having a first unattached end; a second strip attached to an outseam position of the pant leg and having a second unattached end; a bow or knot provided between the first unattached end of the first strip and the second unattached end of the second strip; and a patch portion disposed between the pant leg and the first and second strips.

2 Claims, 5 Drawing Sheets

(56) References Cited

U.S. PATENT DOCUMENTS

| | | | | | |
|---|---|---|---|---|---|
| 1,922,638 | A * | 8/1933 | Reichenbaum | A41D 1/086 | 2/228 |
| 2,229,593 | A * | 1/1941 | Russo | A41D 1/04 | 2/102 |
| 2,406,991 | A * | 9/1946 | Boyce | A41D 19/0044 | D2/621 |
| 3,585,644 | A * | 6/1971 | Bailey | A41D 15/002 | 2/227 |
| 3,763,499 | A | 10/1973 | Bartos et al. | | |
| 4,624,115 | A | 11/1986 | Safrit et al. | | |
| 5,001,782 | A * | 3/1991 | Stewart | A41D 27/08 | 2/244 |
| 5,598,586 | A * | 2/1997 | Munjone | A41D 1/08 | 2/237 |
| 5,815,948 | A * | 10/1998 | Dzielak | A41D 17/00 | 2/22 |
| 7,194,770 | B1 * | 3/2007 | Fecenko | A41D 1/06 | 2/227 |
| D662,281 | S | 6/2012 | Iamartino | | |
| D741,571 | S | 10/2015 | Tulin et al. | | |
| D741,574 | S | 10/2015 | Michaeloff | | |
| 10,412,999 | B1 * | 9/2019 | Garcia | A41D 11/00 | |
| 2011/0184270 | A1 * | 7/2011 | Russell | A61B 5/6804 | 600/388 |
| 2016/0128410 | A1 * | 5/2016 | Fagan | B32B 27/40 | 156/331.7 |
| 2018/0092413 | A1 * | 4/2018 | Reyes | A41D 1/06 | |
| 2019/0134446 | A1 * | 5/2019 | DeYoung | A63B 23/0482 | |

FOREIGN PATENT DOCUMENTS

| | | | | |
|---|---|---|---|---|
| EP | 2042630 B1 | | 5/2012 | |
| FR | 1155516 | | 5/1958 | |
| FR | 1386385 | | 12/1964 | |
| KR | 10-2010-0018955 | * | 2/2010 | A41D 13/0015 |

OTHER PUBLICATIONS amazon.com; "Aelfric Eden Mens Jogger Casual Pants", retrieved on Jul. 23, 2020 from www.amazon.com.

amazon.com; "Women Cargo Denim Pants Casual High Watised Knotted Skinny Jeans Jeggings", retrieved on Jul. 23, 2020 from www.amazon.com.

amazon.com; "GENx Womens Casual Solid Knotted Ribbon Straight Fit Pants HDP9482"; retrieved on Jul. 23, 2020 from www.amazon.com.

B Bar B Wholesale; "Measuring for zipper leg chaps"; retrieved on Aug. 9, 2020 from www.bbarbwholesale.com.

Beautiful Halo; "Mens Cool Simple Plain Fashion Ribbon Detail Cotton Utility Pants Cargo Pants"; retrieved on Jul. 23, 2020 from www.beautifulhalo.com.

Quinn, Gene; "Today in Patent History: Blue Jeans Patented May 20, 1873"; retrieved on Jul. 23, 2020 from www.ipwatchdog.com.

Saks 5th Avenue; "Sacai Patchwork Cargo Trousers"; retrieved on Jul. 23, 2020 from www.saksfifthavenue.com.

Tools for Manufacturing; "Parts of Pants: Different Types of a Jeans Pant Part with Function"; retrieved on Aug. 8, 2020 from www.toolsformanufacturing.com.

Yxneddce; GENx Womens Casual Solid Knotted Ribbon Straight Fit Pants HDP9482; retrieved on Jul. 23, 2020 from www.yxneddce.com.

USPTO; "Fastening Pock-Openings", US Utility Patent issued to J. W. Davis on May 20, 1873. Please note that the current version of USPTO form PTO/SB/08 does not allow entry of 6-digit patent numbers (it gives a Java error).

* cited by examiner

FIT ADJUSTER FOR PANT LEGS

FIELD OF THE INVENTION

The present invention relates to certain improvements in aesthetics and functional portions of pants to improve the fit of the pants to specific wearers.

BACKGROUND OF INVENTION

Pants are available in a wide variety of styles and durability. For example, blue jeans are durable, highly fashionable, and affordable. Other pants may be more fashionable but less durable or less affordable, or more durable but less fashionable and less affordable. For this reason, blue jeans, including jeans of other colors, are extremely popular and well accepted for most situations and occasions. There are literally hundreds of brands (makes) and models of jeans on the market today as a result. Each make and model of jeans has certain characteristics that set them apart from other jeans, such as "skinny jeans" (e.g., tight fitting jeans), stretch-fit jeans, baggy jeans, low-rise jeans, torn jeans, hip-hugger jeans, etc.

SUMMARY OF THE EXEMPLARY EMBODIMENTS OF THE INVENTION

A fit adjuster for a portion of a pant leg is disclosed which comprises a first strip attached to an inseam position of a pant leg and having a first unattached end; a second strip attached to an outseam position of the pant leg and having a second unattached end; a bow or knot provided between the first unattached end of the first strip and the second unattached end of the second strip; and a patch portion disposed between the pant leg and the first and second strips.

BRIEF DESCRIPTION OF THE DRAWINGS

The figures presented herein, when considered in light of this description, form a complete disclosure of one or more embodiments of the invention, wherein like reference numbers in the figures represent similar or same elements or steps.

DETAILED DESCRIPTION OF ONE OR MORE EXEMPLARY EMBODIMENT(S) OF THE INVENTION

The present inventor has recognized that, despite the wide variety of makes and models of pants, especially jeans, available on the market, there exists an unmet need in the art to provide a more customizable fit for jeans. This need arises in several ways. First, a wearer may find a pair of jeans of which he or she really likes the appearance and the fit through the hips, seat and crotch. However, the shape or taper of the legs may be too loose. Second, a wearer may own a pair of favorite or expensive jeans, and then may lose weight causing the legs to fit too loose while the fit through the hips, seat and crotch are still acceptable.

Therefore, at least one objective of the present invention is to provide a functional feature to a pair of pants, such as but not limited to jeans, which allows the fit of the portions of the legs to be reduced. This first objective may be provided on the jeans from the manufacturer.

At least another objective of the present invention is to provide an accessory which can be attached to an existing pair of pants, such as but not limited to jeans, which allows the fit of the portions of the legs to be reduced.

Yet another object of the present invention is to provide a decorative or aesthetic feature to a pair of pants, such as but not limited to jeans, which gives the impression that the pants have been torn or cut and repaired by tying.

These and other objectives and benefits will be readily apparent from the following disclosure of one or more example embodiments, methods of manufacture, and methods of use of the present invention.

Figure 1:
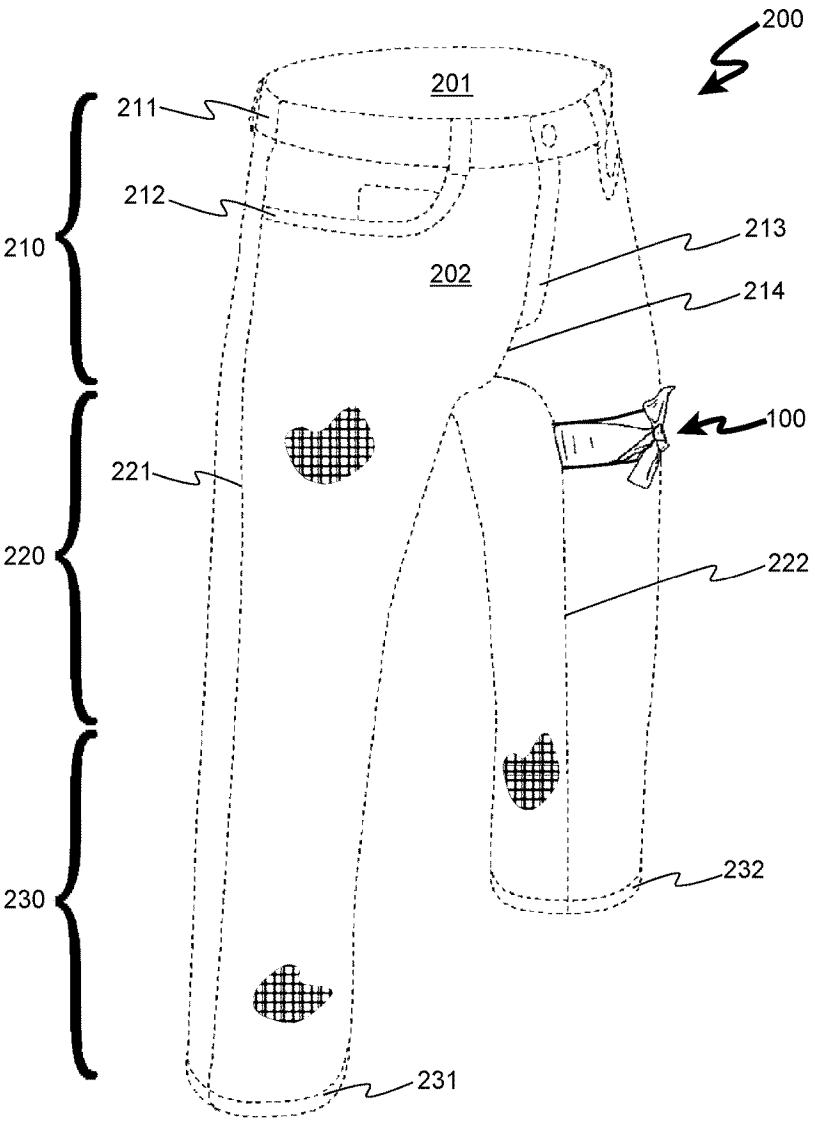
FIG. 1 depicts an example embodiment according to the present invention as attached to or integrated into a pair of pants such as a pair of blue jeans.

Referring now to FIG. 1, a generalized pair of pants 200 is shown in dashed lines having three general portions: an upper portion 210 defining an interior 201 which receives a wearer's lower torso and hips, two symmetric upper leg portions 220 which wraps around a wearer's thighs, and optional lower leg portions 230 which wrap around a wearer's calves (these lower leg portions are omitted or abbreviated in certain versions of pants such as clam diggers, bike pants, short pants, etc.). The exterior 202 of the pants may be of a variety of materials, such as denim or other sheet materials. For reference, this particular pair of generalized pants which are intended to be representative of the full array of pants design available on the market today, has a waist band 211, one or more pockets 212, a fly or closure 213, a crotch seam (or rise) 214, side seams 211 (also referred to as outseams), inseams 222, a hems 231 and 232. Some pants may have additional construction features and elements, and some may have fewer, however, the present invention is potentially beneficial to most if not all of them.

In this particular example embodiment 200, an embodiment of the leg fit adjuster 100 is shown attached to a left upper leg portion 220 extending essentially from in-seam to out-seam, resembling a torn strip from the leg material tied back together. Behind the apparent tied strips is a patch of material which covers the gap created by the cutting of the strips from the leg material. In some embodiments, the strips may be faux strips which are not actually cut from the leg material, so the patch is a faux patch whereas the leg material behind the patch is actually intact. In other embodiments, the patch may be of a different material than the leg material, such as an offset color or pattern, to enhance or stylize the adornment. In other embodiments, the strips may be made from additional material not harvested from the actual leg material, but cut from the same or matching material as the leg panels to give the appearance of being strips of the leg material. In these manners, the tied pant leg fit adjuster may be of functional value in cinching in the circumference of the portion of the pant leg to which it is attached (or from which it is created), or it may be of purely aesthetic and fashion value, or both. Other embodiments may include one or more fit adjusters on the upper portions of the pant legs as well as on the lower portions of the pant legs.

Figure 2:
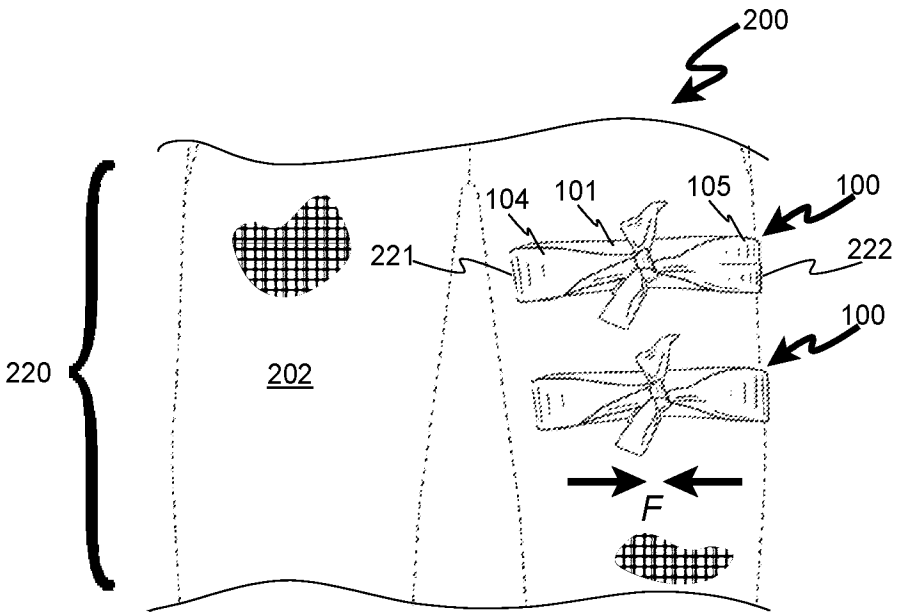
FIG. 2 depicts closer view of another example embodiment attached to or integrated into a pair of pants, including the cinching force provided by at least one embodiment.

Referring now to FIG. 2, two instances of the fit adjuster 100 are shown attached to the inseam 221 and the outseam 222 of an upper portion 220 of a pant leg, creating a cinching force F to pull the two seams 221 and 222 towards each other, effectively tightening the fit of the pant legs in one or more places. The underlying patch 101 is visible in this view, covered in part by the two strips 104 and 105. Again, from this outward appearance, it is not necessarily discernable whether or not the tied strips are really torn from the leg with a real patch, or are purely ornamental (faux), or whether or not the strips are in fact exerting any cinching force F to pull the seams 221 and 222 towards each other.

Figure 3:
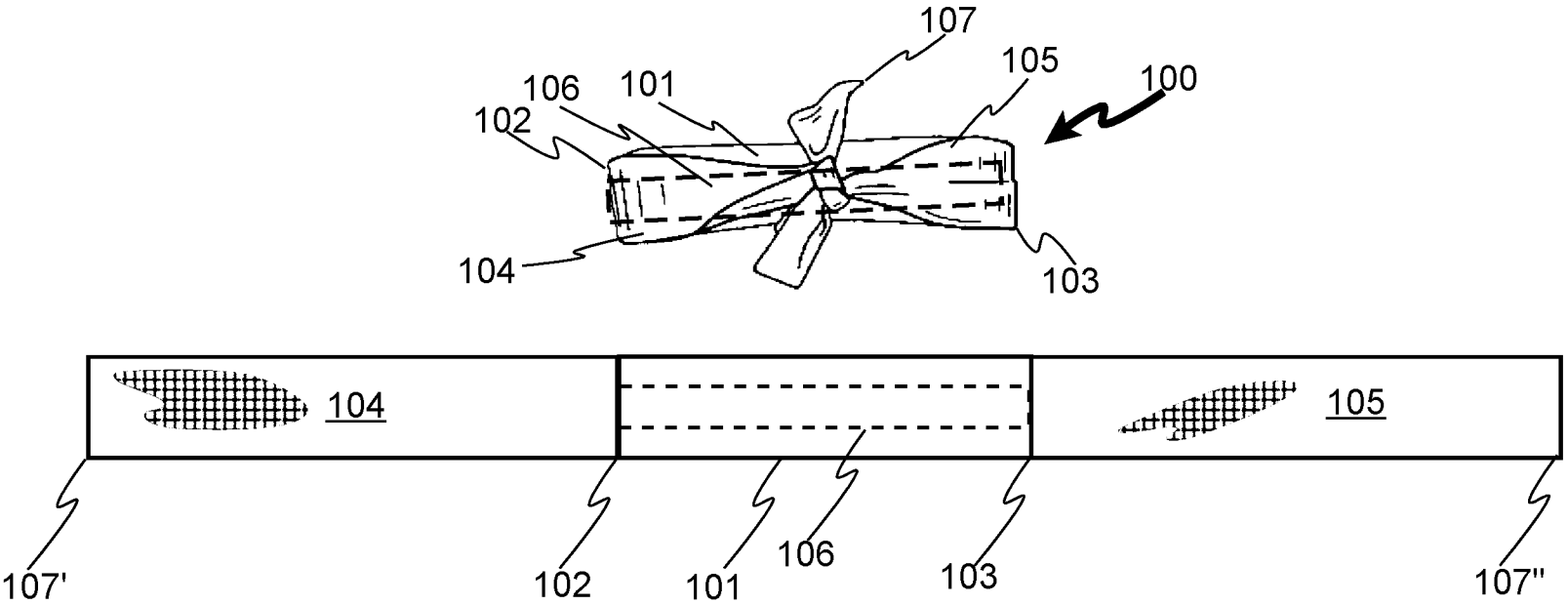
FIG. 3 illustrates one manner of manufacturing an example embodiment according to the present invention of a fit adjuster for legs of pants.

Turning now to FIG. 3, one example method of manufacture of a fit adjuster 100 according to the present invention is shown. In this method, two strips 104 and 105 of material are provided, connected 102 and 103 by patch 101 in between the strips. The strips may be wider than the patch in some embodiments to allow for material consumed by the knot or bow to be created by bringing the far ends 107' and 107" of the strips 104 and 105, respectively together in front of the patch 101 for tying. In other embodiments, the strip ends may be simply attached to each other and a faux bow attached to cover the joint of the strip ends.

Depending on the widths of the strips relative to the width of the patch and on the amount of strip material used to create the knot or bow, the cinching force F to pull the patch-to-strip attachment points 102 and 103 may be created. In some embodiments, a strip of elastic material 106 may be provided behind the patch such that the cinching force F is increased by the contraction force of the elastic. In still other embodiments, the elastic material may be hidden behind the strips instead of behind the patch, or two elastic strips may be placed in both positions (behind the patch and behind the strips).

Figure 4:
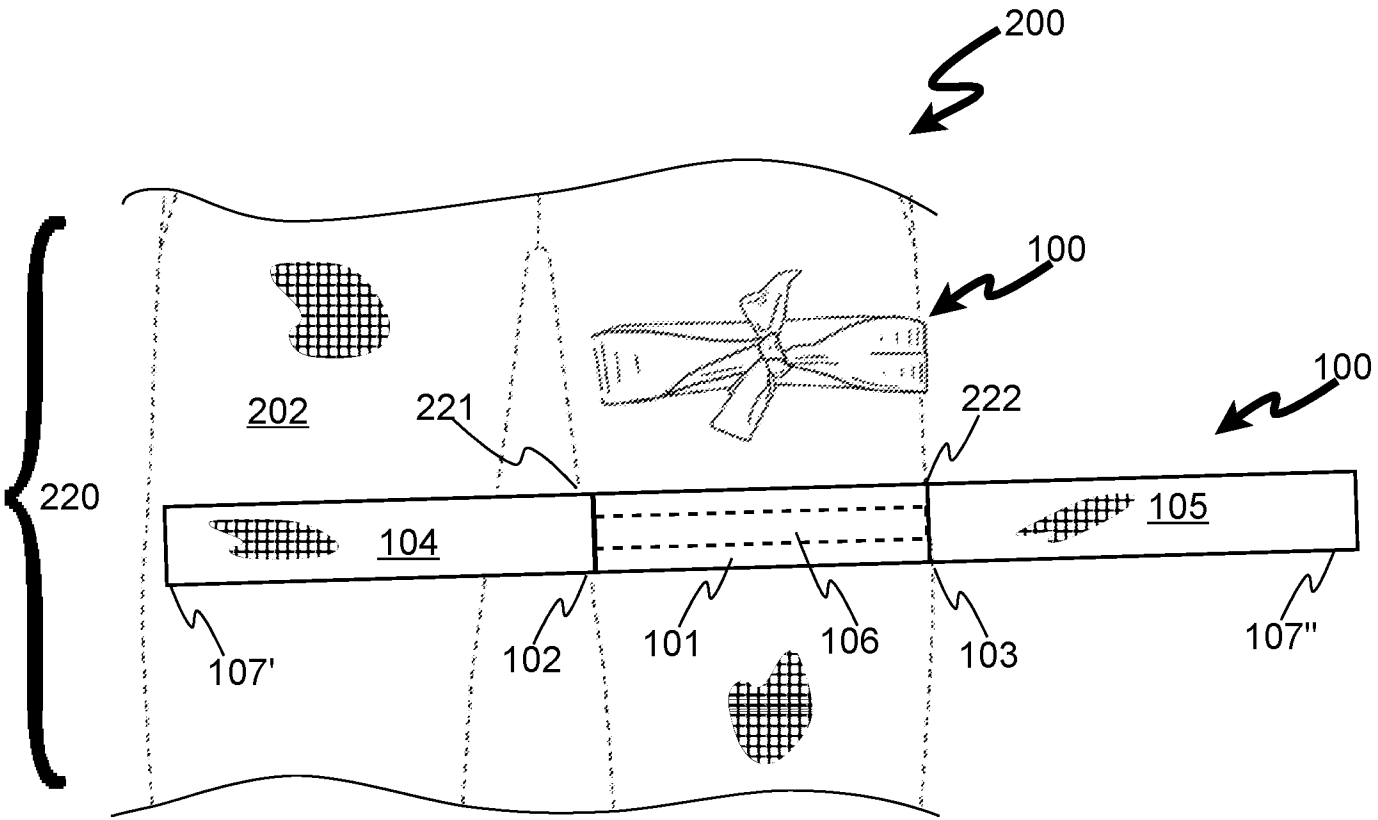
FIG. 4 shows another one manner of manufacturing an example embodiment according to the present invention of a fit adjuster for legs of pants, or alternatively a manner of employing the embodiment of FIG. 3 on a pair of pants.

Referring now to FIG. 4, a manner of making or alternatively manner of attaching and using a fit adjuster 100 according to the present invention is shown. In one manner of making, two parallel horizontal cuts from inseam to outseam are made in the material of the leg portion 220 of the pants 200. Then, a vertical cut is made through the created strip, to create two strips 104 and 105 which are still attached at the pant seams 221 and 222. The two strips are splayed open, and the patch 101 and the optional elastic 106 are affixed in the gap of the pants material created by the cutting. Now, the ends 107' and 107" of the strips can be brought together and tied, or attached to each other and provided with a faux bow. For the method of making in which the strips are actually tied (without a faux bow), the user may be allowed to untie and re-tie the bow to increase or decrease the amount of cinching provided on the leg portion of the pants.

In another manner of use of the fit adjuster 100, the fit adjuster is separately prepared and created apart from a pair of pants 200, and then is affixed at least at the inseam and outseam of the pants 200. In this manner of use, the fit adjuster can be made of matching material to that of the pants material, or of a decorative different material, and may be attached by the pants manufacturer or sold separately as an accessor for use with any pair of pants. The manner of attaching the fit adjuster 100 to the pants seams 200 may be by stitching, pinning, adhesive bonding, or any other suitable technique.

Figure 5:
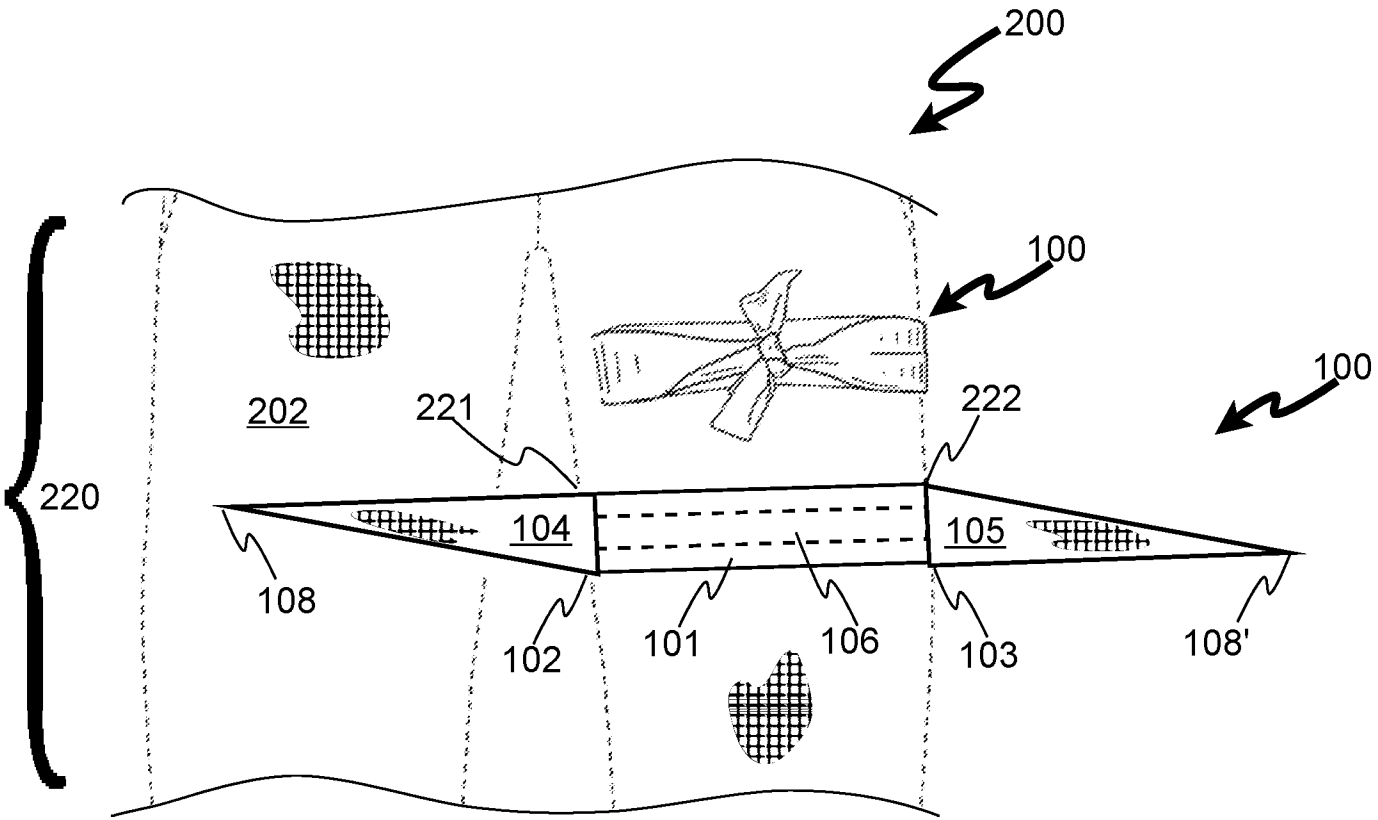
FIG. 5 illustrates another one manner of manufacturing an example embodiment according to the present invention of a fit adjuster for legs of pants, or alternatively a manner of employing a variation of the embodiment of FIG. 3 on a pair of pants.

FIG. 5 illustrates yet another example embodiment which is particularly conducive to making from the front material of a pant leg. In this method, instead of making a vertical cut in the strip, a diagonal cut is made creating two pennant-shaped strips, both of which are the full width of the strip cut from the leg material. Further, their tapered shape yields a less bulky knot or bow when the tapered ends 108 and 108' are the ends to be tied together.

In the foregoing examples and in other embodiments, means known in the art for finishing edges of cut fabric and sheet material are presumed to be understood by the reader, such as but not limited to hemming by stitching and fusible tape. Similarly, means known in the art for attaching portions, strips and panels of sheet material, such as fabric, to each other are presumed to be understood by the reader, such as but not limited to stitching, pinning and adhesive bonding. The embodiments illustrated herein do not represent the full range of embodiments according to the invention, which include, but are not limited to, more strips, fewer strips, various locations on the garment, thinner strips, wider strips, bigger bows, and smaller bows or knots.

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

What is claimed is:

1. A pair of pants comprising:

a pant leg comprising a thigh portion comprising a width extending from an out-seam of the thigh portion to an in-seam of the thigh portion, the width of the thigh portion being equal to the distance between the out-seam of the thigh portion and the in-seam of the thigh portion;

a first pennant-shaped strip of pant material having a vertical side attached to the out-seam of the thigh portion and having a horizontal edge and a diagonal edge;

a second pennant-shaped strip of pant material having a vertical side attached to the in-seam of the thigh portion and having a horizontal edge and a diagonal edge;

a patch of pant material extending horizontally between the out-seam and the in-seam;

wherein the vertical side of the first pennant-shaped strip and the vertical side of the second pennant-shaped strip are attached horizontal from each other;

wherein the diagonal edge of the first pennant-shaped strip is parallel to the diagonal edge of the second pennant-shaped strip, the horizontal edge of the first pennant-shaped strip is parallel to the horizontal edge of the second pennant-shaped strip, the width of the thigh portion is the same as the width of the first pennant-shaped strip, and the width of the thigh portion is the same as the width of the second pennant-shaped strip;

wherein the pennant-shaped strips are movable between an untied configuration and a tied configuration;

wherein when the pennant-shaped strips are in the tied configuration, pointed ends of the first and second pennant-shaped strips are tied into a knot, thereby pulling the out-seam and the in-seam towards each other to tighten the fit of the pant leg in the thigh portion; and wherein when the pennant-shaped strips are in the tied configuration, the patch of pant material is disposed directly behind the first pennant-shaped strip and the second pennant-shaped strip and configured to be disposed between the knot and the wearer of the pair of pants.

2. The pair of pants as set forth in claim 1 further comprising a strip of elastic material disposed between the out-seam and the in-seam.

* * * * *